United States Patent [19]

Tanaka

[11] 4,322,013

[45] Mar. 30, 1982

[54] BREAKDOWN CONTAINER

[76] Inventor: Kenjiro Tanaka, 3-12-30 Chuo Kofu, Yamanashi, Japan

[21] Appl. No.: 141,309

[22] Filed: Apr. 18, 1980

[51] Int. Cl.[3] ..... B65D 1/40; B65D 8/12

[52] U.S. Cl. ..... 220/1 R; 220/1 BC

[58] Field of Search ..... 220/1 R, 1 BC, 72; 222/97, 102, 215; 150/0.5; 229/41 R, 4.5

[56] References Cited

U.S. PATENT DOCUMENTS

| | | | |
|---|---|---|---|
| 3,081,002 | 3/1963 | Tauschinski | 150/0.5 |
| 3,367,380 | 3/1968 | Dickey | 220/41 R |
| 3,595,441 | 7/1971 | Grosjean | 150/0.5 |
| 3,850,338 | 11/1974 | Hotada | 220/1 BC |
| 3,918,603 | 11/1975 | Hatada | 220/1 R |

*Primary Examiner*—George E. Lowrance

*Attorney, Agent, or Firm*—Eugene F. Malin

[57] ABSTRACT

A breakdown cylindrical container comprising a plurality of pre-weakened creases both on the interior side wall and exterior side wall of the container. The location and position of the interior and exterior creases in relation to one another allows the container to be folded into a minimum thickness configuration for easy disposal of the container. The circular top and bottom of the container are positionable in the same plane with their perimeter adjacent one another and lying on top of the flat folded sides or with the top and bottom positioned on opposite sides of the flat folded sides. The near crushable cylindrical portion between the circular top and the flat folded sides and between the circular bottom and the flat folded sides is held to a minimum height.

1 Claim, 5 Drawing Figures

BREAKDOWN CONTAINER

BACKGROUND OF THE INVENTION

The present invention relates to a breakdown cylindrical container having circular ends which can be easily folded to a minimum volume for disposal.

When empty cans are thrown away in their original form they fill waste receptacles in a short time. Also, cans are crushed into irregular and random-shaped volumes and quickly fill waste receptacles.

The present invention overcomes the aforesaid problems by providing a breakdown cylindrical container with a plurality of precreased locations such that the container may be manually folded into a flat folded volume size that takes less space in the waste receptacle even before the near cylindrical portion or portions are crushed to provide an even smaller volume for disposal.

Some 8.8 billion empty cans, such as soft drink, are disposed of each year in Japan. This new phenomenon can be called "empty can pollution". One reason for this new pollution is that empty cans have the same amount of volume as full ones and it seems logical to reduce the volume without the use of any tools or special strength. Cans that are randomly smashed tend to crumple into odd shapes especially when stepped on or smashed. Such smashed cans remain inconvenient to handle.

SUMMARY OF THE INVENTION

In accordance with the present invention, a breakdown cylindrical container with circular ends is employed to reduce the amount of space consumed in a waste receptacle. The breakdown container comprises a plurality of preweakened creases on both the interior side walls and exterior side walls of the container so that the container may be collapsed into a preselected shape.

The circular top and bottom of the container are positionable in the same plane with their perimeter adjacent one another and lying on top of the flat folded sides or with the top and bottom positioned on opposite sides of the flat folded sides. The near cylindrical portion between the circular top and the folded side and between the circular bottom and the folded side is held to a minimum height. The near cylindrical portions of the folded containers may be crushed into an even more compact volume by crushing the near cylindrical portions.

The volume of this folded and crushed near cylindrical portions is less than 20% of the original volume.

As the cans breakdown in identical shapes it is possible to bind them together and the space required for storing will be reduced by about 80%.

The folding creases on the cans should not seriously weaken the strength of the cans.

It is an object of this invention to provide a collapsible cylindrical container having circular ends.

It is another object of this invention to provide a collapsible cylindrical container that is collapsible into a main flat portion with the circular ends positioned in a side by side relation with minimum volume near cylindrical portions between the circular top and the folded sides and between the circular bottom and the folded sides.

A further object is to fold the maximum portion of the container and for positioning the near cylindrical portions for crushing into a smaller volume.

It is an additional object of this invention to provide a can that features easy hand breakdown means by utilizing horizontal inner creases, longitudinal outer creases and triangular shaped outer creases, and results in less-space required for disposal.

In accordance with these and other objects which will be apparent hereinafter, the instant invention will now be described with particular reference to the accompanying drawings.

DESCRIPTION OF THE PREFERRED EMBODIMENT

Figure 1:
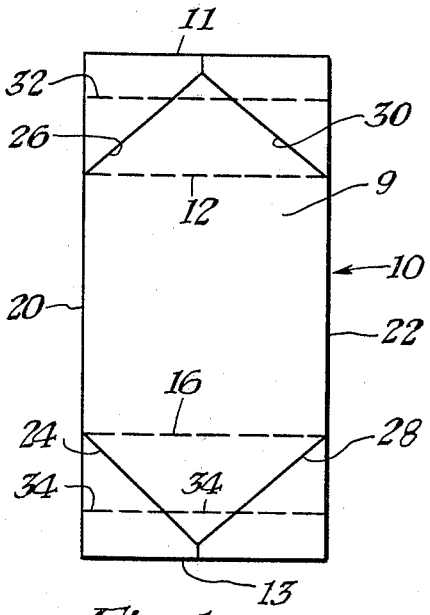
FIG. 1 is the front view of the breakdown cylindrical container with circular ends.
Figure 2:
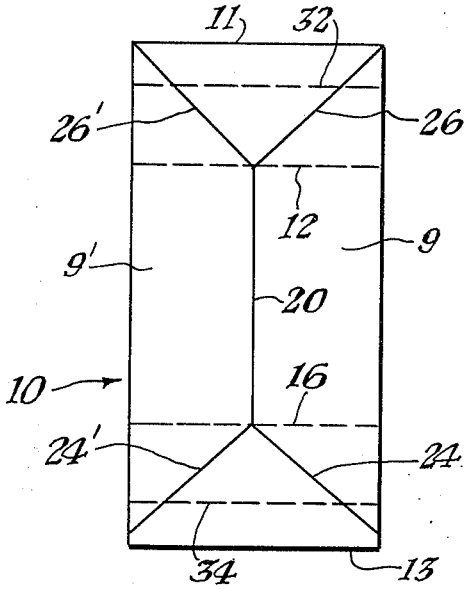
FIG. 2 is a side view of the breakdown container shown in FIG. 1.

Referring to FIGS. 1 and 2, the breakdown container 10 having a circular top rim 11, a top 7, a circular bottom rim 13, bottom 8 and cylindrical side 9. The container 10 has two pair of horizontal interior creases 12 and 16, and horizontal interior creases 32 and 34, a pair of longitudinal exterior creases 20 and 22, and four pair of triangular shaped exterior creases 24, 24', 26, 26', 28, 28', shown in FIG. 4 30 and 30' shown in FIG. 4.

The horizontal interior crease 12 is located at the upper portion of the container body and the horizontal interior crease 16 is located at the lower portion of the container 10.

The longitudinal exterior crease 20 ends and is connected to inner or interior creases 12 and 16 on one side of the container, while the longitudinal exterior crease 22 ends and is connected to interior creases 12 and 16 on the other side of the can. The longitudinal exterior creases 20 and 22 being bisymmetrical.

The lower triangular shaped exterior creases 24 and 24' as well as 28 and 28' connect from the points of intersection of interior crease 16 and the longitudinal exterior creases 20 and 22 respectively. The uper triangular shaped exterior creases 26 and 26' as well as 28 and 28' connected from the points of intersection of interior crease 12 and the longitudinal exterior creases 20 and 22 respectively. An additional crease may be used, that is, a horizontal creases 32 and 34 run parallel to interior creases 12 and 16, creases 32 and 34 may be viewed as the base of the triangle in FIG. 2.

Figure 3:
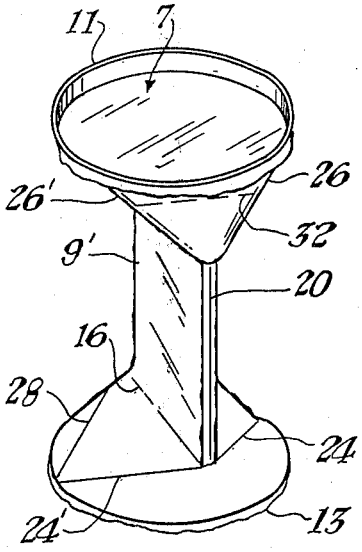
FIG. 3 is a perspective view of the breakdown container in a partially collapsed position with the main portion folded into a flat configuration.

When the breakdown container becomes empty, the first portion of the cylindrical can to be depressed by hand as shown in FIG. 3 by sides 9 and 9'. The longitudinal exterior creases 20 and 22 allow sides 9 and 9' to be flattened against one another as shown in FIG. 3.

The longitudinal creases and triangular creases are pressed bisymmetrically. The empty cans can therefore be broken down easily due to the creases, which simplifies disposal.

Figure 4:
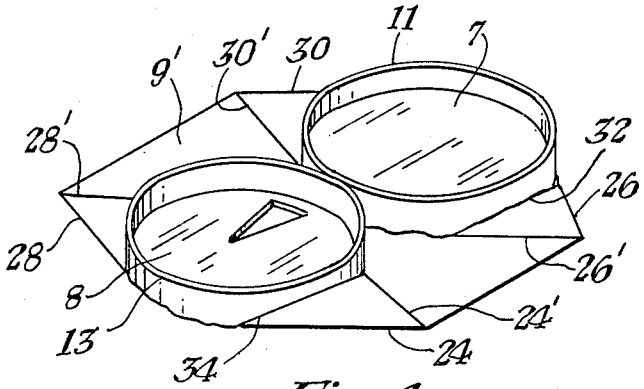
FIG. 4 is a perspective view of the breakdown container in a fully folded position with the ends folded onto the same side.
Figure 5:
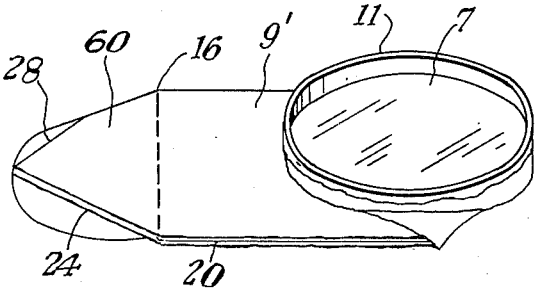
FIG. 5 is a perspective view of the breakdown container in a fully folded position with the ends folded onto opposite sides.

While the sides are being flattened, both ends are folded by using triangular shaped exterior creases 24, 24', 26, 26', 28, 28', 30 and 30' as illustrated in FIG. 3. The top 7 and bottom 8 may take on a gentle convex shape due to stress, not illustrated. The interior creases 12 and 16 allow the upper and lower ends of sides 9 and 9' to be moved to a position as shown in FIG. 4 or to a position as shown in FIG. 5. The folding of the ends can be effected by simply folding each end over on the same side as shown in FIG. 4 or folding one on one side and the other on the other side as shown in FIG. 5.

Creases 32 and 34 which add in allowing the ends to collapse easier are optional, and if deleted, the triangular shaped exterior creases 24, 24', 26, 26', 28, 28', 30, and 30' will be extended to the upper and lower edges of the container.

Above creases are pressed during can manufacture.

The near crushable cylindrical portions in FIG. 4 shown below the rim 11 or rim 13 and the flattened portions 9 and 9' may be crushed to a smaller height. Note FIG. 5 where rim 11 has been crushed to move it closer to the portion 9'.

Creases 20 and 22 are positioned axially in relation to the cylindrical body. Creases 24, 24', 26, 26', 12, 16, 32 and 34 are non axial creases.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A breakdown cylindrical metal container capable of being folded as one unit by hand, comprising:

a cylindrical body having an upper portion, a main portion, and a bottom portion, said main portion having a first side and second side, a circular top, a circular bottom, at least a first and second circular interior crease, said first circular interior crease positioned adjacent said circular top and said second circular interior crease positioned adjacent said circular bottom, a pair of bisymmetrical axial exterior creases in said main portion on opposite sides of said body, said pair of bisymmetrical axial creases intersecting with said first and second circular interior creases; and a first pair of generally triangular shaped exterior creases positioned in said upper portion between said circular top and said first circular interior crease and a second pair of generally triangular shaped exterior creases positioned in said bottom portion between said circular bottom and said second circular interior crease;

positioning means for said first pair and said second pair of creases to be positioned in relation to the intersection of said bisymmetrical axial creases with said first and second circular interior creases for defining a predetermined generally flat configuration with said main portion folded into a two thickness configuration with said first side flat against said second side and for positioning said circular top and said circular bottom in parallel relation with said first and second sides.

* * * * *